US011258190B2

(12) United States Patent
Fisher

(10) Patent No.: US 11,258,190 B2
(45) Date of Patent: Feb. 22, 2022

(54) DIRECT BURIAL GROUND LUG/ CONNECTOR

(71) Applicant: Frederick Scott Fisher, Winchester, VA (US)

(72) Inventor: Frederick Scott Fisher, Winchester, VA (US)

( * ) Notice: Subject to any disclaimer, the term of this patent is extended or adjusted under 35 U.S.C. 154(b) by 95 days.

(21) Appl. No.: 16/677,037

(22) Filed: Nov. 7, 2019

(65) Prior Publication Data

US 2020/0153127 A1 May 14, 2020

Related U.S. Application Data

(60) Provisional application No. 62/757,516, filed on Nov. 8, 2018.

(51) Int. Cl.

| | |
|---|---|
| ***H01R 4/66*** | (2006.01) |
| ***H01R 4/36*** | (2006.01) |
| ***H01R 4/60*** | (2006.01) |
| ***H01R 4/64*** | (2006.01) |
| ***H01R 4/30*** | (2006.01) |

(52) U.S. Cl.

CPC ..... *H01R 4/66* (2013.01); *H01R 4/305* (2013.01); *H01R 4/36* (2013.01); *H01R 4/60* (2013.01); *H01R 4/646* (2013.01)

(58) Field of Classification Search

CPC ... H01R 4/66; H01R 4/36; H01R 4/60; H01R 4/305; H01R 4/646

USPC ..... 439/92, 95, 801, 810, 814

See application file for complete search history.

(56) References Cited

U.S. PATENT DOCUMENTS

| | | | | |
|---|---|---|---|---|
| 5,957,733 | A * | 9/1999 | Mello | H01R 4/30 439/814 |
| 6,443,783 | B1 * | 9/2002 | Beadle | H01R 9/2425 439/718 |
| 7,607,955 | B2 * | 10/2009 | Hill | H01R 11/07 439/798 |
| 7,618,299 | B2 * | 11/2009 | Ferretti | H01F 27/04 439/798 |
| 7,918,693 | B2 * | 4/2011 | Thomas | F16B 41/002 439/797 |
| 8,202,131 | B2 * | 6/2012 | Battle | H01R 4/36 439/796 |
| 8,348,706 | B2 * | 1/2013 | Yu | H01R 4/36 439/814 |
| 8,834,211 | B2 * | 9/2014 | Sommer | H01R 4/646 439/814 |
| 2007/0026745 | A1 * | 2/2007 | Ferretti | H01R 4/36 439/814 |
| 2014/0322990 | A1 * | 10/2014 | Umlaut | H01R 4/304 439/814 |

* cited by examiner

*Primary Examiner* — Khiem M Nguyen

(74) *Attorney, Agent, or Firm* — Millen, White, Zelano & Branigan, P.C.; Ryan R. Pool; William F. Nixon

(57) ABSTRACT

The invention relates to a direct burial ground lug. The lug is preferably constructed of a phosphor bronze material. The block may have two through holes to install two conductors, rods, cables, and the like. Stainless steel threaded screws are used to hold the rod and ground conductor in a stable condition. The threaded screws insert into threaded holes positioned perpendicular to the through holes. The direct burial ground lug allows the ground rod and ground conductor to be connected for a continuous grounding system.

20 Claims, 7 Drawing Sheets

DIRECT BURIAL GROUND LUG/ CONNECTOR

FIELD OF THE INVENTION

The present invention relates to a direct burial ground connector for joining two independent ground rods, cables, and the like under or above ground. More particularly, the invention can be directly installed in concrete or earth without the use of special tools and requires only one simple tool for installation.

DESCRIPTION OF RELATED ART

Currently, the need for using larger grounding connectors has become more common, with engineers and electrical designers requiring larger grounding electrode conductors for the premises grounding systems. Grounding connectors may require the use of special tools or instruments for installation of the conductors. These grounding connectors have open jaws or grooves to hold the ground rods, cables, and the like. Many of these enclosures are made of aluminum, copper etc. with multiple parts and pieces. The price of the metal and the use of multiple components increases the cost of these grounding connectors.

SUMMARY OF THE INVENTION

A direct burial metal ground lug is disclosed. The lug design advantageously allows for a reduction in the amount material which needs to be cast while still maintaining a durable wall thickness and excellent structural integrity. The metal block includes two portions. Preferably, the block made of a C510 phosphor bronze material. The first portion has a first through hole (102) and first threaded hole (104) having an axis perpendicular to an axis of the first through hole. The second portion has a second through hole (103) and a second threaded hole (105) having an axis perpendicular to an axis of the second through hole. The diameter of the second through hole is less than the diameter of the first through hole.

In a preferred embodiment, a direct burial ground lug including a joint portion to connect the first portion and the second portion is disclosed.

In a preferred embodiment, a direct burial ground lug including two threaded screws is disclosed. The first threaded screw (107) engages the first threaded hole and extends into its first through hole. The second threaded screw (108) engages the second threaded hole and extends into its second through hole.

In a preferred embodiment, a ground lug is disclosed which includes a block having a first through hole and a second through hole. The first through hole is greater in diameter than the second through hole. The ground lug also includes the block having a first threaded hole and a second threaded hole. Each threaded hole has an axis perpendicular to an axis of its respective through hole. The ground lug also includes a joint portion (106) to join the first through hole and the second through hole. The ground lug also includes two threaded screws to engage each threaded hole. The screws extend into the through holes. The joint (106) design between the two thread screws adds integrity while the screws are being torqued.

BRIEF DESCRIPTION OF THE DRAWINGS

Various other features and advantages of the present invention will be more fully appreciated as the same becomes better understood when considered in conjunction with the accompanying drawings.

DETAILED DESCRIPTION OF THE PREFERRED EMBODIMENTS

Reference will now be made in detail to specific embodiments of the present invention. Examples of these embodiments are illustrated in the accompanying drawings. Numerous specific details are set forth in order to provide a thorough understanding of the present invention. While the embodiments will be described in conjunction with the drawings, it will be understood that the following description is not intended to limit the present invention to any one embodiment. On the contrary, the following description is intended to cover alternatives, modifications, and equivalents as may be included within the spirit and scope of the appended claims. Numerous specific details are set forth in order to provide a thorough understanding of the present invention.

A key feature of the disclosed embodiments is the direct burial ground lug that does not require the use of special tools or instruments. One tool for installation of the rod and conductor may be used. The direct burial ground connector may fit onto two different sizes of ground rods, cables, and the like. Moreover, costs to produce the direct burial ground lug are reduced because of the lower price of material. Costs also may be reduced due to less components in the ground lug.

In a preferred embodiment phosphor bronze was selected as an appropriate material for the ground lug because of its high level of purity and anti-corrosive properties. Preferably, the material is phosphor bronze C510, although phosphor bronze C511, C426 or C521 may also be used. Phosphor bronze tends to deteriorate when exposed to air by forming an oxidation layer on the surface thereof. This oxidation layer is unattractive in appearance and may reduce the conductivity of the electrical terminal, and therefore the reliability over time. Thus, phosphor bronze embodiments may optionally be plated or encapsulated to overcome the deterioration and aesthetic issues.

Alternatively, stainless steel, copper or brass may be used to form the ground lug. In such embodiments, the preferred material is copper 194, although copper 195, 197 and possibly 110 and 102 may also be used. Alternatively, the outer surface of stainless steel, copper or brass ground lugs may optionally be plated or encapsulated.

In preferred embodiments, the disclosed ground lug is a C510 cast bronze connection component used to establish a secure ground connection with stainless steel allen screws between a #3/0 copper grounding electrode conductor and a ¾ inch grounding rod or #6 re-bar. The need for such a connection component is pronounced as projects require the largest grounding electrode conductor in the designs to grounding rods and concrete encased electrodes as part of the premises grounding electrode system.

Figure 1:
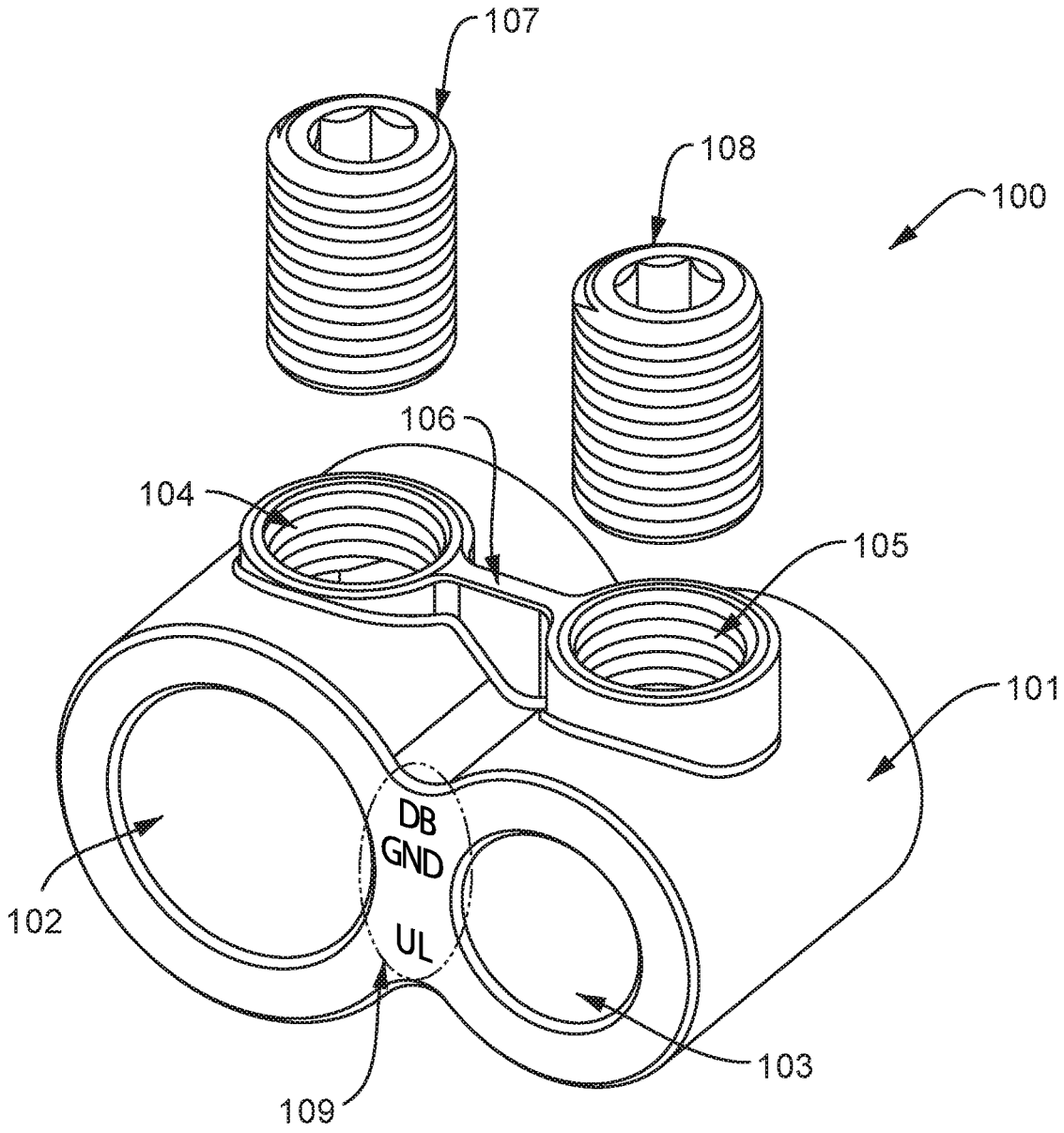
FIG. 1 illustrates a perspective view of a direct burial ground lug according to the disclosed embodiments.

FIG. 1 depicts a direct burial ground lug 100 according to the disclosed embodiments. The direct burial ground lug 100 includes metal block 101. It is preferred that the block 101 may be made from C510 phosphor bronze in order to promote conductivity, strength, and corrosion resistance. The metal block 101 includes of two through holes 102, 103, wherein the through hole 102 (i.e., a first through hole) is greater in diameter than the through hole 103 (i.e., a second through hole). The through holes 102, 103 may accept the two independent ground rods, cables, and the like. The metal block 101 also includes two threaded holes 104 (i.e., first threaded hole), 105 (i.e., second threaded hole), connected to the through holes 102, 103. The threaded hole 104 has an axis perpendicular to axis of the through hole 102. The threaded hole 105 has an axis perpendicular to axis of the through hole 103.

The metal block 101 also includes a joint portion 106 between the threaded holes 104 and 105. Joint portion 106 may address the issue of false current. Any current generated using ground lug 100 will pass through the joint portion 106 to the grounding rod coupled to the lug. The joint portion 106 promotes a continuous ground loop.

The direct burial ground lug 100 also includes two threaded locking screws 107, 108. The threaded locking screws 107, 108 may be composed of stainless steel for strength and corrosion resistance purposes. As shown, the threaded locking screws 107, 108 fit onto the threaded holes 104, 105.

The direct burial ground lug 100 also includes the surface 109. The surface 109 has three markings "DB", "GND", and "UL". "DB" and "GND" are markings that identify the direct burial ground lug 100 be suitable for direct burial and ground. "UL" is a designation for Underwriters Laboratory™.

Figure 2A:
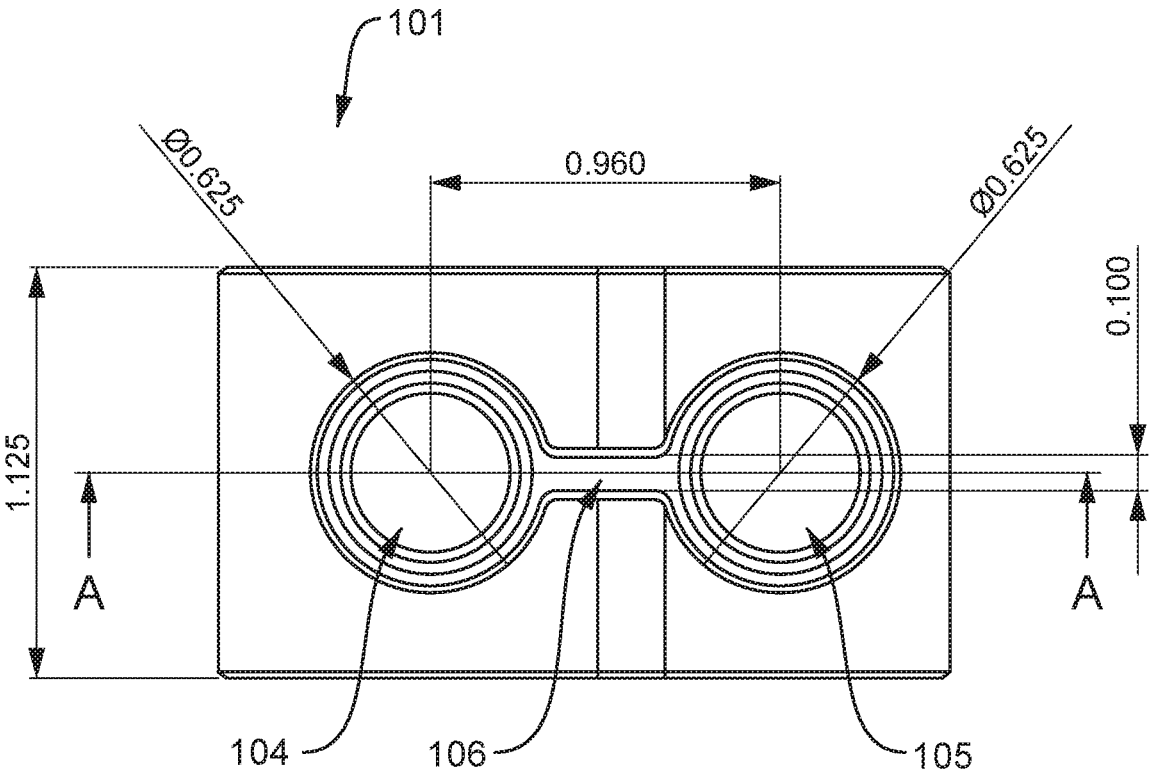
FIG. 2A illustrates a preferred embodiment showing a top view of a metal block of the direct burial ground lug of FIG. 1 according to the disclosed embodiments.

FIG. 2A depicts the top view of the block 101 according to the disclosed embodiments. The block 101 includes the two threaded holes 104, 105. The dimension of the threaded holes 104, 105 may be about 0.625 inches. The threaded holes 104, 105 have their axes spaced from each other by a distance of about 0.960 inches. The height of the block 101 is about 1.125 inches. The block 101 also has a joint portion 106 connected the threaded holes 104 and 105. The thickness of the joint portion 106 is about 0.100 inches.

Figure 2B:
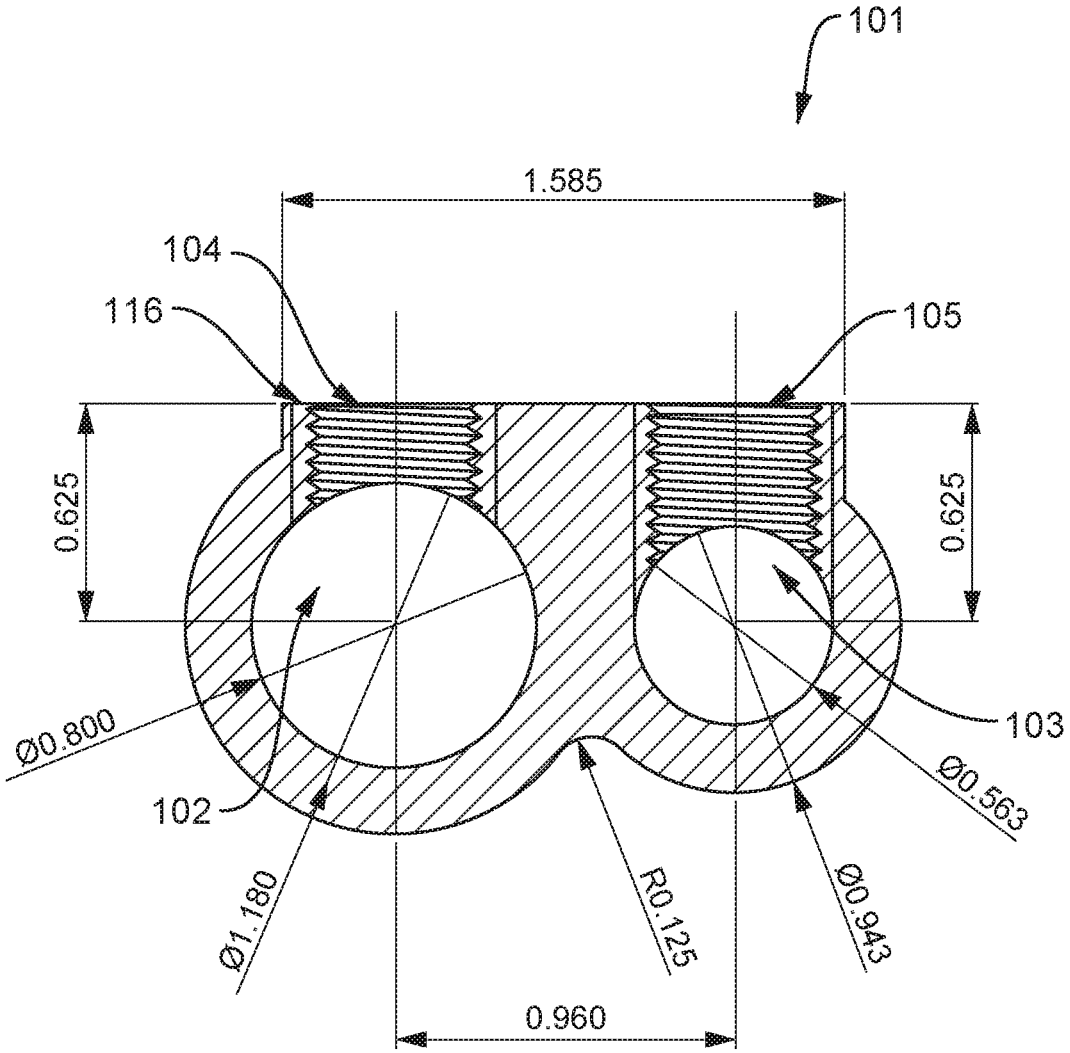
FIG. 2B illustrates a preferred embodiment showing a cross-sectional view along lines A-A of the metal block in FIG. 2A according to the disclosed embodiments.

FIG. 2B shows the cross-sectional view along lines A-A of the block 101 in FIG. 2A. The inner diameter of the through hole 102 is about 0.800 inches and the inner diameter of the through hole 103 is about 0.563 inches. The outer diameter of the through hole 102 is about 1.180 inches and the outer diameter of the through hole 103 is about 0.943 inches. The through holes 102, 103 have their axes spaced from each other by a distance of about 0.960 inches. The top portion 116 of the block 101 is about 1.585 inches. The distance between the top portion 116 to the center of the through hole 102 is about 0.625 inches and the distance between the top portion 116 to the center of the through hole 102 is about 0.625 inches.

Figure 3:
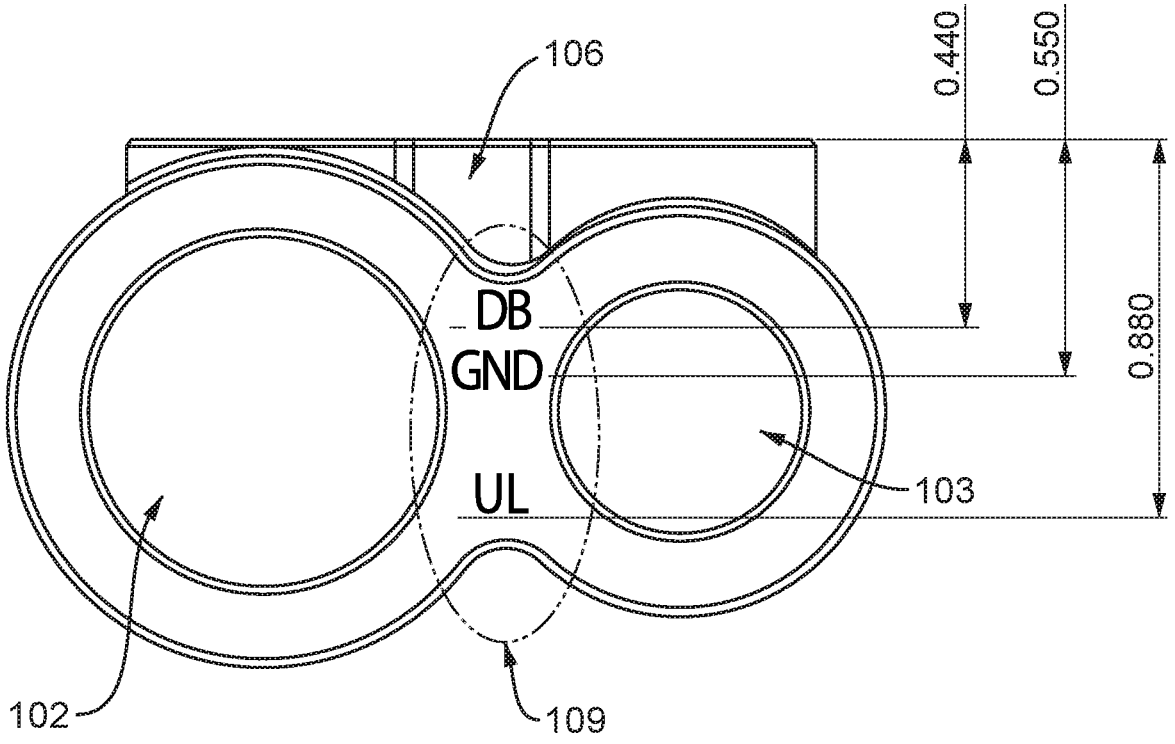
FIG. 3 illustrates a preferred embodiment showing identification information on direct burial ground lug of FIG. 1 according to the disclosed embodiments.

FIG. 3 depicts the surface 109 having three markings "DB", "GND", and "UL". This information must be present on the block 101 by cast or engraving. The preferred dimensions for the marking also are shown.

Figure 4:
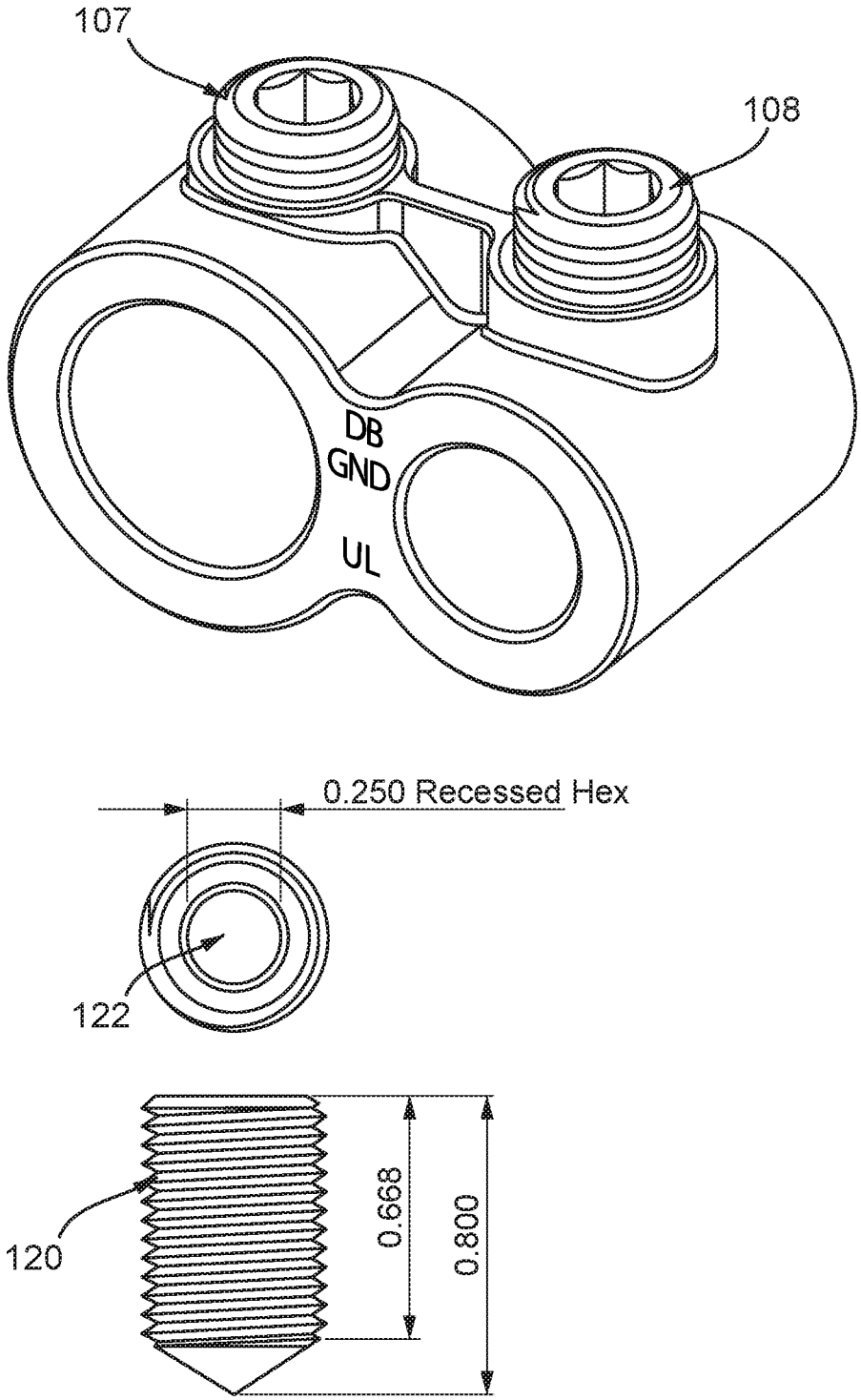
FIG. 4 illustrates a preferred embodiment showing top and side views of a threaded locking screw according to the disclosed embodiments. The locking screw has a pointed tip.

FIG. 4 shows a threaded locking screw 120. The threaded locking screw 120 is recessed hex head 122. The dimension of the recessed hex head of the threaded locking screw is about 0.250 inches. The threaded locking screw 120 is ½-20 threads and is preferably comprised of stainless steel. The length of the threaded locking screw 120 is about 0.800 inches. The threaded locking screw 120 preferably withstands a maximum of 35 ft. lbs. or (420 in lbf) of torque with no evidence of stressed threads, stripping or any degradation whatsoever. The threaded locking screw 120 is the detail information of the threaded locking screws 107, 108.

Figure 5:
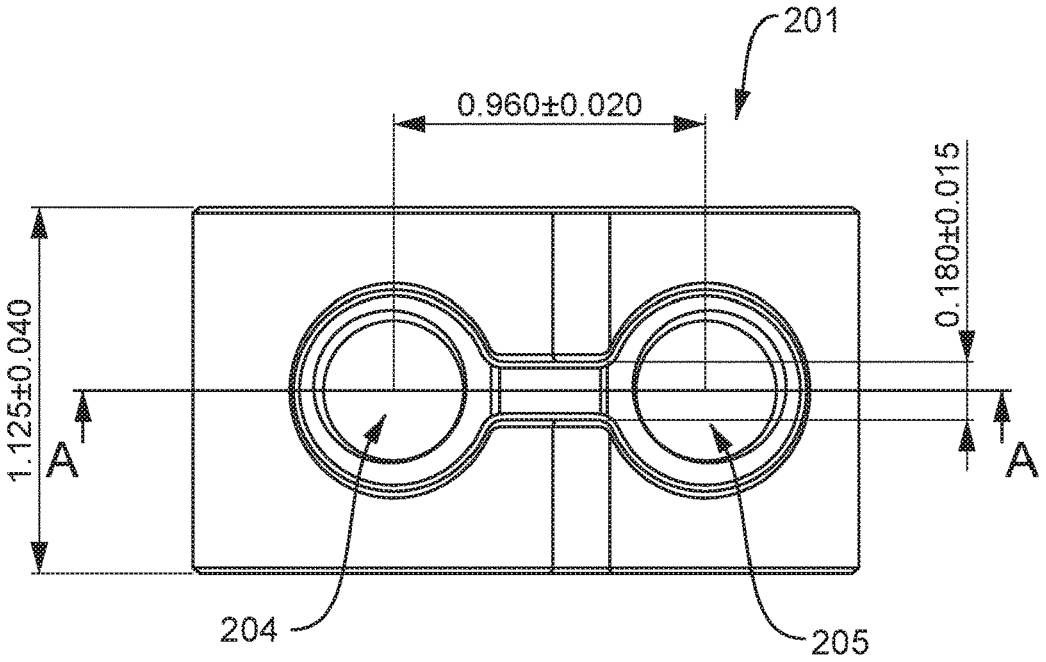
FIG. 5 illustrates a preferred embodiment showing a top view of a metal block of the direct burial ground lug of FIG. 6 according to the disclosed embodiments.

FIG. 5 depicts the top view of the block 201 according to the disclosed embodiments. The block 201 includes the two threaded holes 204, 205. The threaded holes 204, 205 have their axes spaced from each other by a distance of about 0.960 inches. The height of the block 201 is about 1.125 inches. The block 201 also has a joint portion 206 connected the threaded holes 204 (i.e., first threaded hole) and 205 (i.e., second threaded hole). The thickness of the joint portion 206 is about 0.180 inches.

Figure 6:
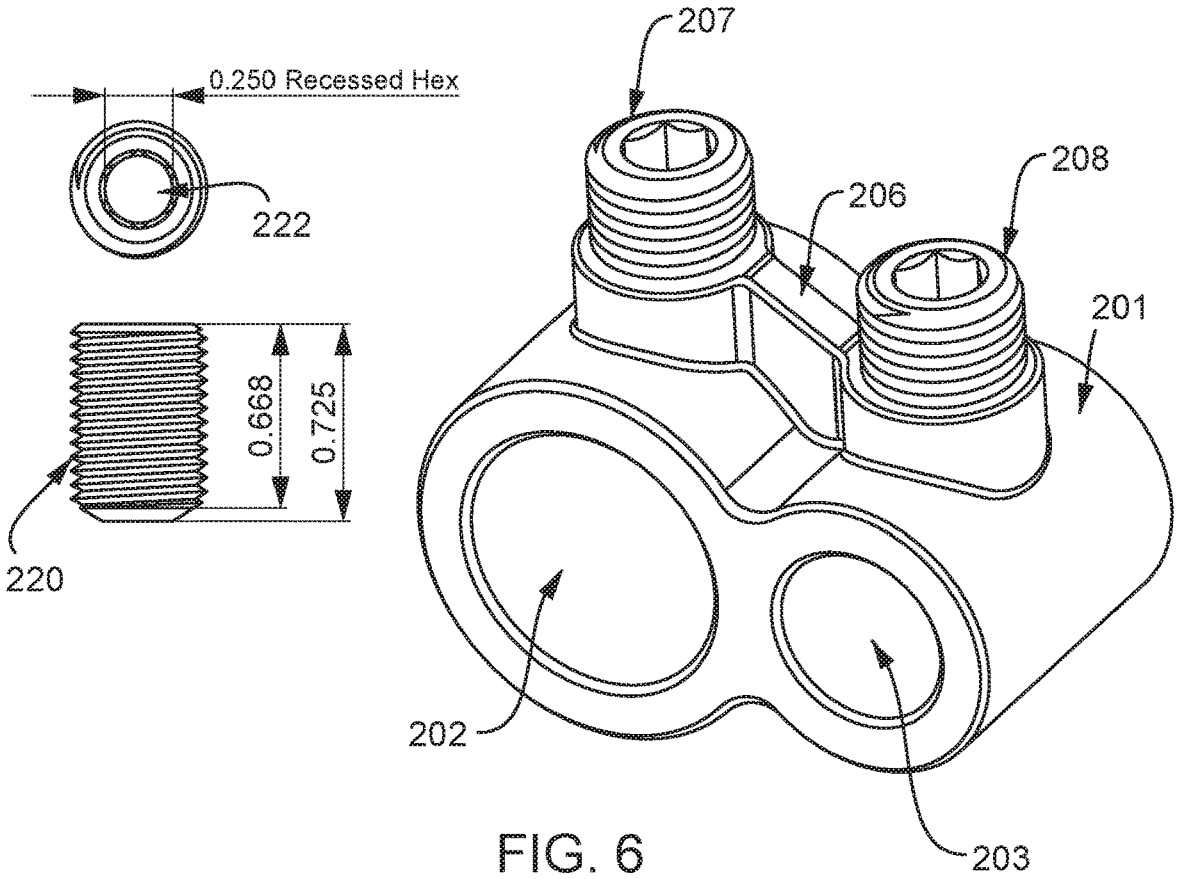
FIG. 6 illustrates a preferred embodiment showing top and side views of a threaded locking screw according to the disclosed embodiments. The locking screw has a flat tip.

FIG. 6 shows a threaded locking screw 220. The threaded locking screw 220 is recessed hex head 222. The dimension of the recessed hex head of the threaded locking screw is about 0.250 inches. The threaded locking screw 220 is ½-20 threads and is preferably comprised of stainless steel. The length of the threaded locking screw 220 is about 0.725 inches. The threaded locking screw 220 preferably withstands a maximum of 35 ft. lbs. or (420 in lbf) of torque with no evidence of stressed threads, stripping or any degradation whatsoever. The threaded locking screw 220 is the detail information of the threaded locking screws 207, 208.

The metal block 201 also includes a joint portion 206 between the threaded holes 204 and 205. Joint portion 206 may address the issue of false current. Any current generated using ground lug will pass through the joint portion 206 to the grounding rod coupled to the lug. The joint portion 206 promotes a continuous ground loop.

The direct burial ground lug also includes two threaded locking screws 207, 208. The threaded locking screws 207, 208 may be composed of stainless steel for strength and corrosion resistance purposes. As shown, the threaded locking screws 207, 208 fit onto the threaded holes 204, 205.

Figure 7:
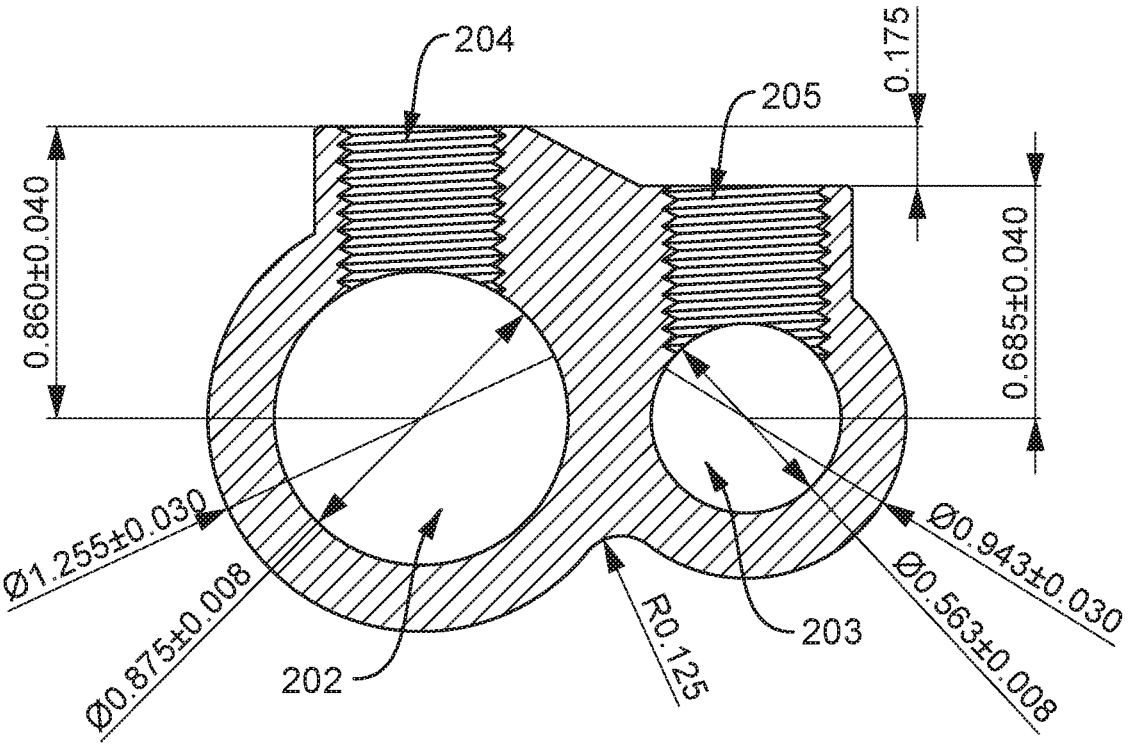
FIG. 7 illustrates a preferred embodiment showing a cross-sectional view along lines A-A of the metal block in FIG. 5 according to the disclosed embodiments.

FIG. 7 shows the cross-sectional view along lines A-A of the block 201 in FIG. 2A. The inner diameter of the through hole 202 (i.e., a first through hole) is about 0.875 inches and the inner diameter of the through hole 203 (i.e., a second through hole) is about 0.563 inches. The outer diameter of the through hole 202 is about 1.255 inches and the outer diameter of the through hole 203 is about 0.943 inches. The distance between the top portion 206 to the center of the through hole 202 is about 0.860 inches and the distance between the top portion 266 to the center of the through hole 202 is about 0.685 inches.

Figure 8:
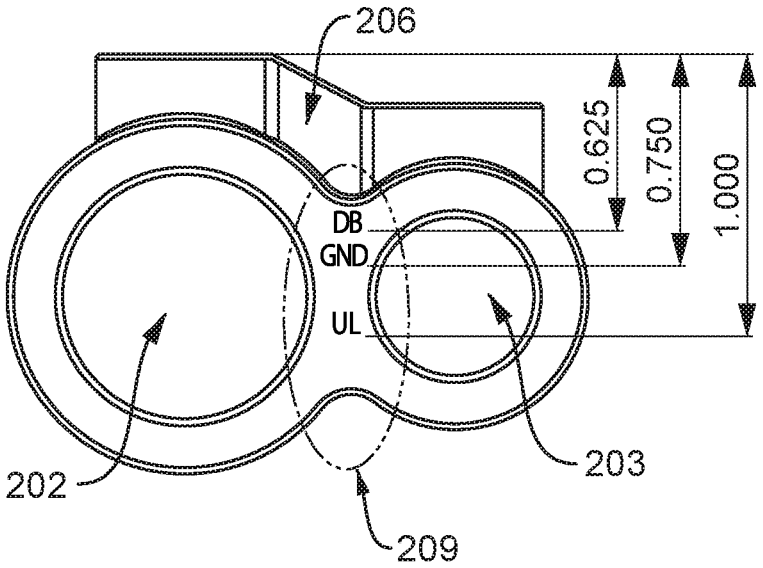
FIG. 8 illustrates a preferred embodiment showing identification information on direct burial ground lug of FIG. 5 according to the disclosed embodiments.

FIG. 8 depicts the surface 209 having three markings "DB", "GND", and "UL". This information must be present on the block 201 by cast or engraving. The preferred dimensions for the marking also are shown.

Thus, the disclosed embodiments include the direct burial ground lug that can be directly installed in concrete or earth with regard to anti-corrosion. Further, the disclosed ground lug may employ three parts: the body, the two Allen screws, and the rods. The ground lug may consist of two through holes, two threaded holes, and a consistent outer wall thickness. The ground lug may serve as a connector for two independent or separate ground rods. A first rod may be installed into a first hole and a second rod may be installed in a second hole, as disclosed above. Both locking screws are installed into the female threaded holes and torqued against the rods with a specified torque value. The end result is that the ground rods or ground circuit is connected for a continuous ground loop.

Although the invention has been described in detail above, it is expressly understood that it will be apparent to those skilled in the art that various modifications to the disclosed may be made without departing from the spirit or scope of the invention. Thus, it is intended that the present invention covers the modifications and variations disclosed above provides that these changes come within the scope of the claims and their equivalents.

The invention claimed is:

1. A ground lug comprising:

a metal block consisting of a first portion, a second portion, a joint portion, wherein said first portion comprises a first through hole and a first threaded hole having an axis perpendicular to an axis of the first through hole, wherein said second portion comprises a second through hole and a second threaded hole having an axis perpendicular to an axis of the second through hole, wherein a diameter of the second through hole is less than a diameter of the first through hole;

wherein said joint portion connects the first portion and the second portion; and wherein said first and second threaded holes are suitable for receiving a first threaded screw and a second threaded screw, respectively.

2. A ground lug comprising:

a block consisting of a first through hole, a second through hole, wherein the first through hole is greater in diameter than the second through hole, a first threaded hole, a second threaded hole, wherein each threaded hole has an axis perpendicular to an axis of its respective through hole;

a joint portion wherein said joint portion joins the first through hole and the second through hole; and two threaded screws engaged with each of said first and second threaded hole.

3. A ground lug according to claim 1 wherein said metal block is made from phosphor bronze.

4. A ground lug according to claim 1 wherein said metal block is made from C510 phosphor bronze.

5. A ground lug according to claim 1 wherein said threaded locking screws are flat tip.

6. A ground lug according to claim 1 wherein said threaded locking screws are pointed tip.

7. A ground lug according to claim 1 wherein said threaded locking screws have recessed hex heads.

8. A ground lug according to claim 1 wherein said metal block is made from stainless steel which is optionally coated.

9. A ground lug according to claim 1 wherein the first through hole is between 0.75 to 0.9 inches in diameter.

10. A ground lug according to claim 1 wherein the second through hole is between 0.5 and 0.6 inches in diameter.

11. A ground lug according to claim 9 wherein the first through hole is about 0.875±0.008 inches in diameter.

12. A ground lug according to claim 10 wherein the second through hole is about 0.563±0.008 inches in diameter.

13. A ground lug according to claim 12 wherein said metal block is made from phosphor bronze.

14. A ground lug according to claim 2 wherein the first through hole is between 0.75 to 0.9 inches in diameter.

15. A ground lug according to claim 2 wherein the second through hole is between 0.5 and 0.6 inches in diameter.

16. A ground lug according to claim 2 wherein said threaded locking screws are flat tip.

17. A ground lug according to claim 1 wherein the joint portion aligns the center-points of said first and second through holes along a common axis.

18. A ground lug according to claim 2 wherein the joint portion aligns the center-points of said first and second through holes along a common axis.

19. A ground lug comprising:

a metal block including a first portion comprising a first through hole and a first threaded hole wherein said first threaded hole has an axis perpendicular to an axis of the first through hole, a second portion comprising a second through hole and a second threaded hole wherein said second threaded hold has an axis perpendicular to an axis of the second through hole, wherein a diameter of the second through hole is less than a diameter of the first through hole;

a first joint portion which connects the first portion and the second portion; and a second joint portion which connects the threaded holes wherein said first and second joint portions are positioned generally perpendicular to each other, wherein the first and second threaded holes are suitable for engaging a threaded screw.

20. A ground lug according to claim 19 wherein the first joint portion aligns the center-points of said first and second through holes along a common plane.

* * * * *